US005338892A

United States Patent [19]

Sekine et al.

[11] Patent Number: 5,338,892

[45] Date of Patent: Aug. 16, 1994

[54] MUSICAL TONE GENERATION APPARATUS UTILIZING PITCH DEPENDENT TIMING DELAY

[75] Inventors: Satoshi Sekine; Junichi Fujimori, both of Shizuoka, Japan

[73] Assignee: Yamaha Corporation, Hamamatsu, Japan

[21] Appl. No.: 85,478

[22] Filed: Jun. 9, 1993

Related U.S. Application Data

[63] Continuation of Ser. No. 568,900, Aug. 17, 1990, abandoned.

[30] Foreign Application Priority Data

Sep. 16, 1989 [JP] Japan ..... 1-240472

[51] Int. Cl.[5] ..... G10H 5/00; G10H 1/02

[52] U.S. Cl. ..... 84/662; 84/630; 84/DIG. 26; 84/DIG. 27

[58] Field of Search ..... 84/615, 625, 626, 630, 84/653, 660, 662, DIG. 1, DIG. 26, DIG. 27

[56] References Cited

U.S. PATENT DOCUMENTS

| | | | |
|---|---|---|---|
| 4,303,991 | 12/1981 | Moore | 84/630 |
| 4,338,581 | 6/1982 | Morgan | 84/DIG. 26 X |
| 4,577,540 | 3/1986 | Yamana | 84/665 |
| 4,586,417 | 5/1986 | Kato et al. | 84/DIG. 26 X |
| 4,622,878 | 11/1986 | Sharp | 84/DIG. 27 X |
| 4,731,835 | 3/1988 | Futamase et al. | 84/DIG. 26 X |
| 4,966,051 | 10/1990 | Tajima | 84/663 |
| 5,000,074 | 3/1991 | Inoue et al. | 84/621 |
| 5,027,689 | 7/1991 | Fujimori | 84/622 |
| 5,065,433 | 11/1991 | Ida et al. | 84/DIG. 26 X |
| 5,127,306 | 7/1992 | Mitsuhashi et al. | 84/665 |

*Primary Examiner*—William M. Shoop, Jr.
*Assistant Examiner*—Jeffrey W. Donels
*Attorney, Agent, or Firm*—Spensley Horn Jubas & Lubitz

[57] ABSTRACT

An electronic musical tone generating apparatus includes a tone pitch designating unit for generating pitch signal representing tone pitch, a tone generation instruction unit for generating start signal instructing tone generation, a musical tone signal generating unit for generating a pair of musical tone signals representing a pair of direct sounds and a plurality of musical tone signals each representing a reflect sound in accordance with the start signal, wherein there can be difference of tone volume between respective musical tone signals of the pair of musical tone signals, and differences of tone volume and tone generation timing between respective musical tone signals of the plurality of musical tone signals, a controlling unit for controlling the difference of tone volume and the difference of tone generation timing in accordance with the pitch signal of the tone pitch designating unit, and a converting unit for converting the musical tone signals to musical sound.

19 Claims, 5 Drawing Sheets

MUSICAL TONE GENERATION APPARATUS UTILIZING PITCH DEPENDENT TIMING DELAY

This is a continuation of application Ser. No. 07/568,900 filed on Aug. 17, 1990, now abandoned.

TITLE OF THE INVENTION

The present invention relates to a musical tone generation apparatus suitably used in an electronic musical instrument, an automatic performance machine, and the like and, more particularly, to a technique for imitating musical tone generation of an acoustic musical instrument.

In general, in an acoustic musical instrument having an instrument body (e.g., a piano, organ, vibraphone, guitar, and the like), a tone reflected by the instrument body is mixed with a direct tone from a sound source, and a tone mixture is produced, so that a musical tone having senses of spread and depth can be obtained. In particular, in a large musical instrument such as a piano, sound image localization in a right-and-left direction can be recognized.

FIG. 4 exemplifies a tone generation state of a piano. A tone generated from a sound source position $S_L$ of a bass part reaches right and left ears at a measurement point M as a direct tone $D_L$, and also reaches the right and left ears as a reflected tone $R_L$ from a piano main body PC. A tone generated from a sound source position $S_H$ of a treble part reaches the right and left ears as a direct tone $D_H$, and also reaches the right and left ears as a reflected tone $R_H$ from the piano main body PC. For this reason, the bass and treble tones are respectively heard from the left and right sides as those having senses of spread and depth.

As a conventional electronic musical instrument which can imitate sound image localization in the right-and-left direction, the following instrument is known. This instrument has two, i.e., right and left tone generation channels, produces a tone of a bass part so that a tone volume of the left tone generation channel is larger than that of the right tone generation channel, and produces a tone of a treble part so that a tone volume of the right tone generation channel is larger than that of the left tone generation channel.

The conventional apparatus described above is not satisfactory to imitate musical tone generation of an acoustic musical instrument such as a piano, as shown in FIG. 4. More specifically, since the conventional instrument merely controls a tone volume difference between the right and left channels, it can obtain a sense of direction of a tone but cannot be obtain senses of spread and depth of a tone, resulting in unnatural sound image localization.

SUMMARY OF THE INVENTION

It is an object of the present invention to provide a novel musical tone generation apparatus which can effectively imitate musical tone generation of an acoustic musical instrument.

In order to achieve the above object, according to the present invention, there is provided an electronic musical tone generating apparatus comprising tone pitch designating means for generating pitch signal representing tone pitch, tone generation instruction means for generating start signal instructing tone generation, musical tone signal generating means for generating a pair of musical tone signals representing a pair of direct sounds and a plurality of musical tone signals each representing a reflect sound in accordance with the start signal, wherein there can be difference of tone volume between respective musical tone signals of the pair of musical tone signals, and differences of tone volume and tone generation timing between respective musical tone signals of the plurality of musical tone signals, controlling means for controlling the difference of tone volume and the difference of tone generation timing in accordance with the pitch signal of the tone pitch designating means, and converting means for converting the musical tone signals to musical sound.

A first musical tone generation apparatus according to the present invention comprises an instruction means for instructing a generation timing shift of a second tone with respect to a first tone in units of pitch groups (or pitches). Every time a pitch is designated, first and second musical tone signals having the designated pitch are generated to have the generation timing shift instructed by the instruction means in correspondence with the designated pitch, thus producing tones.

In the first musical tone generation apparatus, the instruction means may instruct a tone volume difference between the second tone and the first tone in units of pitch groups (or pitches), and the signal generation means may generate the first and second musical tone signals to have a tone volume difference instructed by the instruction means in correspondence with the designated pitch.

A second musical tone generation apparatus according to the present invention comprises an instruction means for instructing a generation timing shift and a tone volume difference between a second tone and a first tone in units of pitch groups (or pitches). Every time a pitch is designated, first and second musical tone signals having the designated pitches are generated to have the generation timing shift and the tone volume difference instructed by the instruction means in correspondence with the designated pitch, and are subjected to tone generation in corresponding first and second tone generation channels.

In the second musical tone generation apparatus, the instruction means may instruct a generation timing shift and a tone volume difference between a third tone and the first tone in units of pitch groups (or pitches), and a generation timing shift and a tone volume difference between a fourth tone and the third tone. The signal generation means may generate a third musical tone signal having the designated pitch and corresponding to the first tone generation channel to have the generation timing shift and the tone volume difference between the first and third tones instructed by the instruction means in correspondence with the designated pitch with respect to the first musical tone signal, and may generate a fourth musical tone signal having the designated pitch and corresponding to the second musical tone channel to have the generation timing shift and the tone volume difference between the third and fourth tones instructed by the instruction means with respect to the third musical tone signal upon generation of the first and second musical tone signals. These third and fourth musical tone signals may be subjected to tone generation in the first and second tone generation channels.

According to the first musical tone generation apparatus described above, a generation timing shift between a direct tone $D_{L1}$ and a reflected tone $R_{L1}$ associated with a sound source position $S_L$ shown in FIG. 4 is determined in correspondence with the first and second tones. When a pitch corresponding to $S_L$ is designated, first and second musical tone signals respectively approximate to $D_{L1}$ and $R_{L1}$ are sequentially generated. Since such musical tone generation is performed according to a predetermined generation timing shift in units of pitch groups (or pitches), musical tone generation imitating tone reflection in an instrument housing can be performed, and a musical tone having senses of spread and depth can be obtained.

When the first and second musical tone signals are generated to have a tone volume difference corresponding to the designated pitch, tone reflection in the instrument body can be more faithfully imitated.

According to the second musical tone generation apparatus described above, a generation timing shift and a tone volume difference between a direct tone $D_{L1}$ and a reflected tone $R_{L1}$ associated with a sound source position $S_L$ shown in FIG. 4 are determined in correspondence with the first and second tones. When a pitch corresponding to $S_L$ is designated, first and second musical tone signals respectively approximate to $D_{L1}$ and $R_{L1}$ are sequentially generated from the first and second tone generation channels. In this case, since not only a difference between right and left tone volumes but also a difference between arrival times to right and left ears are reflected in sound image localization based on two-channel tone generation, natural localization can be attained. Since such two-channel tone generation is performed to have a predetermined generation timing shift and tone volume difference in units of pitch groups (or pitches), sound image localization of an acoustic musical instrument can be faithfully imitated.

Furthermore, when third and fourth musical tone signals are respectively generated from the first and second tone generation channels, a generation timing shift and a tone volume difference between tones $R_{L1}$ and $R_{L2}$ in FIG. 4 are determined in advance in correspondence with the third and fourth tones, so that third and fourth musical tone signals respectively approximate to $R_{L1}$ and $R_{L2}$ can be generated. Therefore, tone reflection in the instrument body is also reflected in sound image localization, and sound image localization of an acoustic musical instrument can be more faithfully imitated.

DESCRIPTION OF THE PREFERRED EMBODIMENT

Figure 1:
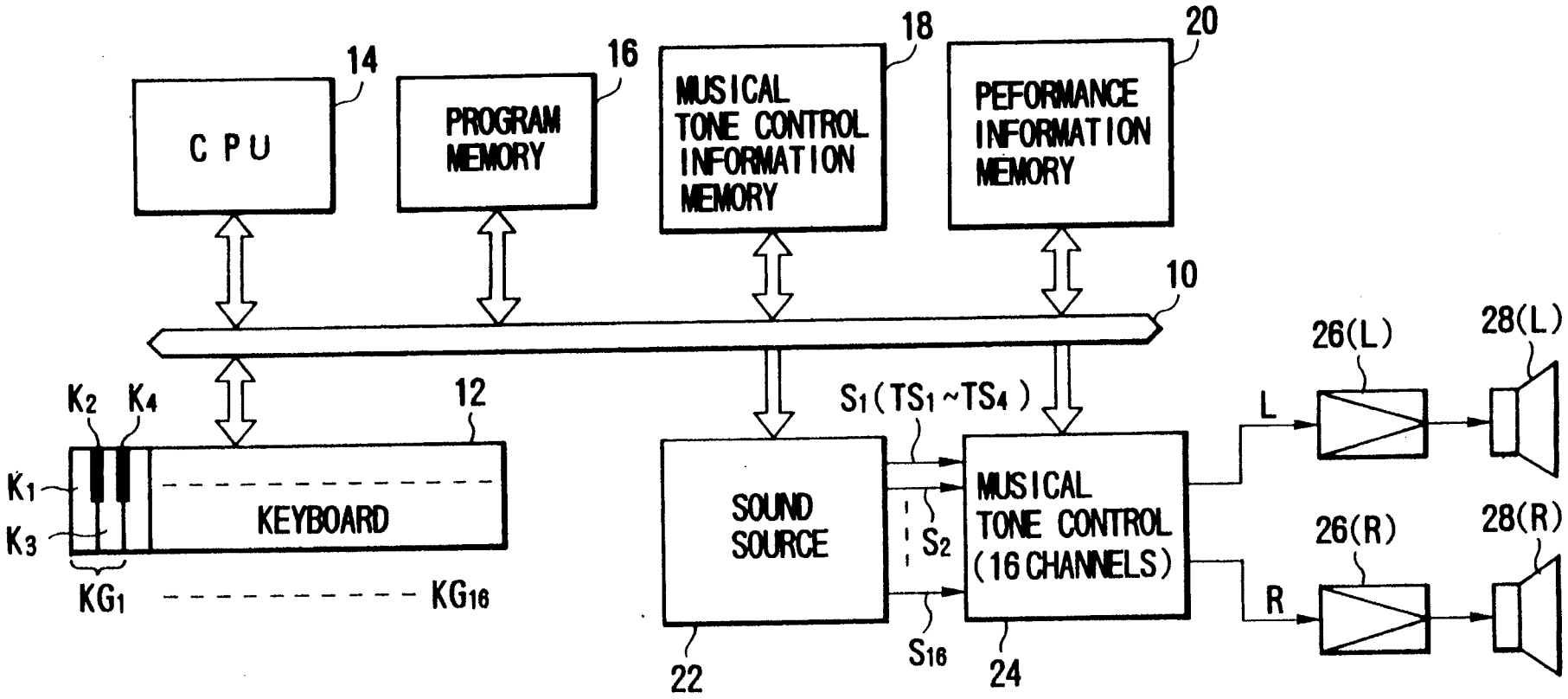
FIG. 1 is a block diagram showing an arrangement of an electronic musical instrument according to an embodiment of the present invention.

FIG. 1 shows an arrangement of an electronic musical instrument according to the present invention. Musical tone generation of this electronic musical instrument is controlled by a microcomputer.

Arrangement of Instrument (FIG. 1)

A bus 10 is connected to a keyboard 12, a central processing unit (CPU) 14, a program memory 16, a musical tone control information memory 18, a performance information memory 20, a sound source circuit 22, a musical tone control circuit 24, and the like.

The keyboard 12 has a large number of keys, and key operation information is detected by electrical scanning in units of keys. The large number of keys are classified into key groups $KG_1$ to $KG_{16}$ (pitch groups) each including four keys like a key group $KG_1$ including keys $K_1$ to $K_4$. Musical tone control (to be described later) is performed in units of key groups.

The CPU 14 executes various processing operations for musical tone generation in accordance with a program stored in the program memory 16.

Figure 2:
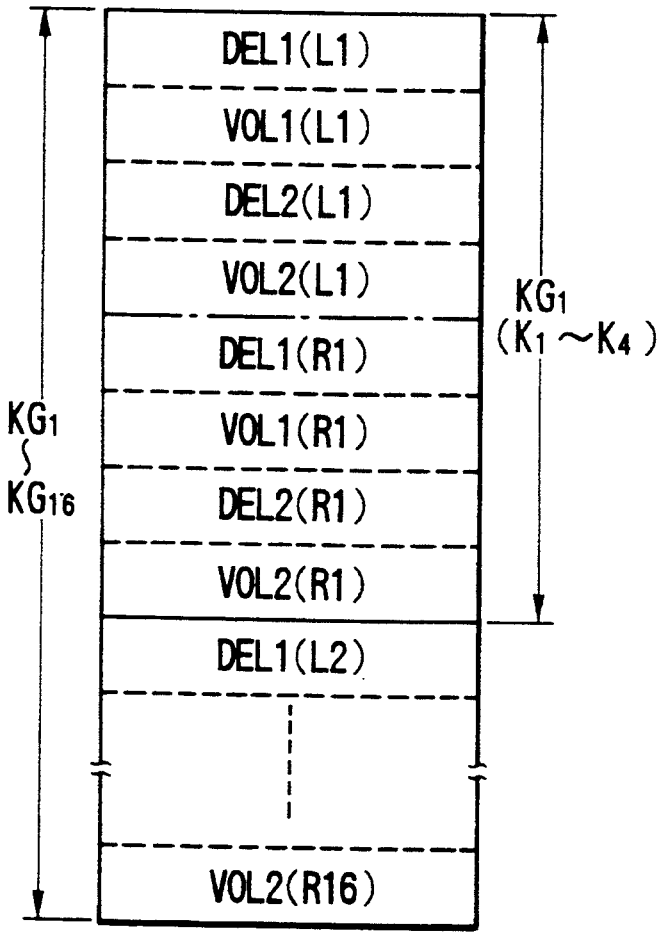
FIG. 2 shows a storage format of musical tone control information.

The musical tone control information memory 18 comprises a ROM (read-only memory) or a RAM (random access memory), and stores musical tone control information in units of the key groups $KG_1$ to $KG_{16}$, as shown in FIG. 2.

In FIG. 2, musical tone control information corresponding to, e.g., the key group $KG_1$ includes data associated with a left tone generation channel, i.e., DEL1(L1), VOL1(L1), DEL2(L1), and VOL2(L1), and data associated with a right tone generation channel, i.e., DEL1(R1), VOL1(R1), DEL2(R1), and VOL2(R1). The data DEL1(L1), DEL2(L1), DEL1(R1), and DEL2(R1) are delay control data, and the data VOL1(L1), VOL2(L1), VOL1(R1), and VOL2(R1) are tone volume control data. Each delay control data represents a delay stage count corresponding to a desired delay amount, and each tone volume control data represents a coefficient corresponding to a desired tone volume. Musical tone control information for each of the remaining key groups $KG_2$ to $KG_{16}$ is stored as for the key group $KG_1$.

The performance information memory 20 comprises a ROM or a RAM, and stores performance information for automatically performing a desired music piece. When an automatic performance mode is selected by a performance mode selection switch (not shown), automatic performance can be performed using performance information stored in the memory 20 in place of performance information from the keyboard 12.

Musical tone signal generation of the sound source circuit 22 is controlled by the CPU 14, and has 16 output lines $S_1$ to $S_{16}$ corresponding to the key groups $KG_1$ to $KG_{16}$.

For example, when the key $K_1$ is depressed on the keyboard 12, the CPU 14 detects this ON event, and supplies pitch information and ON information corresponding to the key $K_1$ to the sound source circuit 22. In response to the input information, the sound source circuit 22 forms a musical tone signal $TS_1$ having a pitch corresponding to the key $K_1$, and outputs it from the output line $S_1$. Thereafter, when the key $K_1$ is released, the CPU 14 detects this OFF event, and controls the sound source circuit 22 to start to attenuate the musical tone signal $TS_1$.

Any of musical tone signals $TS_2$ to $TS_4$ corresponding to the keys $K_2$ to $K_4$ can be similarly output from the output line $S_1$. Musical tone signal generation of other output lines $S_2$ to $S_{16}$ is similarly controlled, and a musical tone signal corresponding to a key belonging to a corresponding key group can be output in units of output lines.

The musical tone control circuit 24 has 16 musical tone control channels corresponding to the key groups $KG_1$ to $KG_{16}$. Each musical tone control channel receives a musical tone signal from an output line of a corresponding key group from the sound source circuit 22, and also receives musical tone control information of the corresponding key group from the memory 18. Each musical tone control channel controls a delay amount and a tone volume of the input musical tone signal in units of right and left tone generation channels in accordance with input musical tone control information, and this control operation will be described in detail below with reference to FIG. 3.

A left channel musical tone signal L and a right channel musical tone signal R are extracted from the musical tone control circuit 24 and are supplied to and produced at left and right loudspeakers 28(L) and 28(R) through left and right output amplifiers 26(L) and 26(R), respectively.

Figure 3:
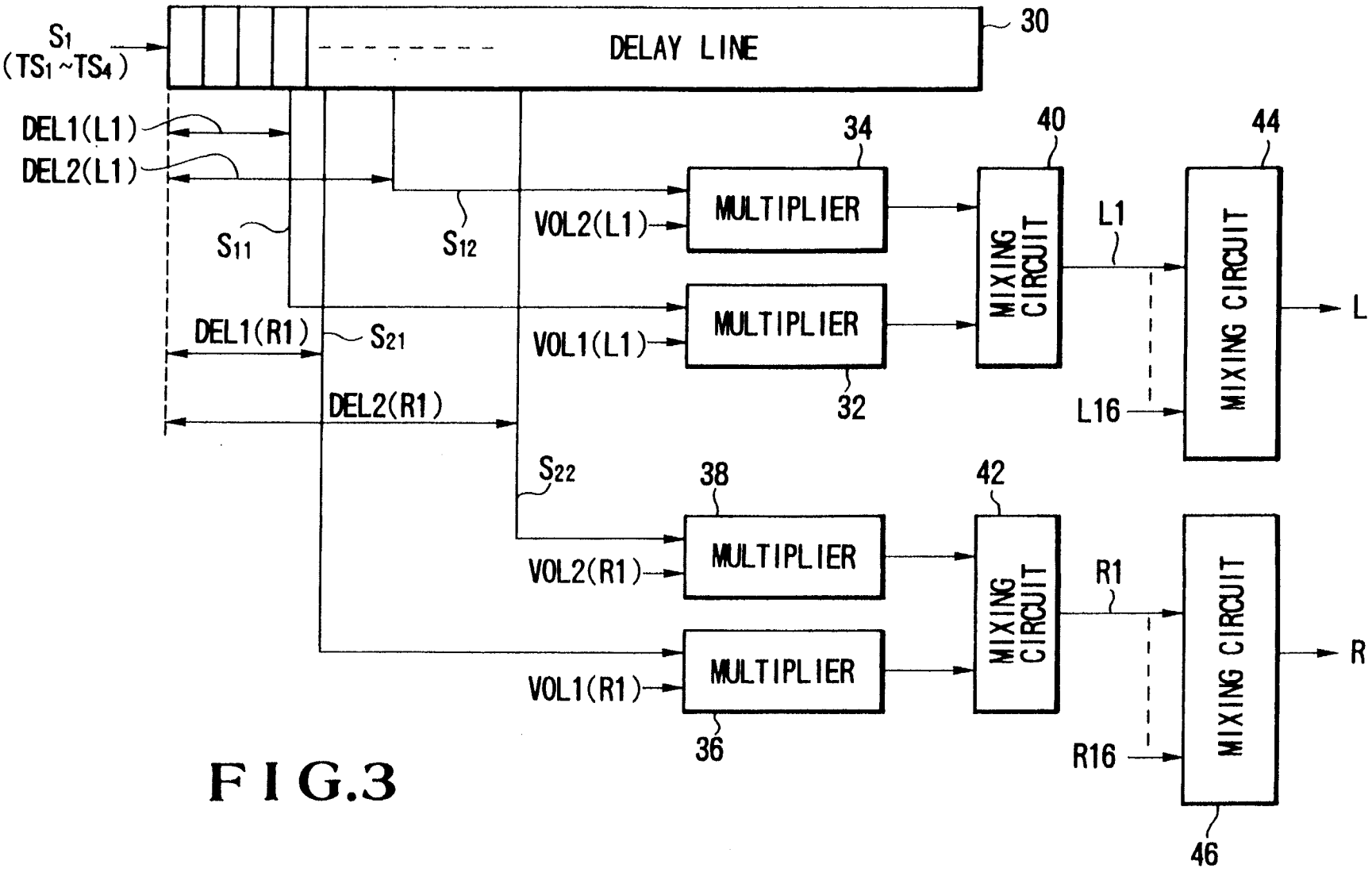
FIG. 3 is a circuit diagram of a musical tone control channel corresponding to a key group $KG_1$.

Musical Tone Control Channel (FIG. 3)

FIG. 3 shows an arrangement of a musical tone control channel corresponding to, e.g., the key group $KG_1$.

A delay line 30 receives one or a plurality of musical tone signals $TS_1$ to $TS_4$ from the output line $S_1$ of the sound source circuit 22.

When the CPU 14 supplies pitch information to the sound source circuit 22, as described above, it discriminates one of the key groups $KG_1$ to $KG_{16}$ to which the pitch information belongs, reads out musical tone control information corresponding to the discriminated key group from the memory 18, and supplies the readout information to the musical tone control circuit 24. When pitch information corresponding to the key $K_1$ is supplied to the sound source circuit 22, as described above, musical tone control information corresponding to the key group $KG_1$ is supplied to the musical tone control circuit 24. More specifically, of the data corresponding to the key group $KG_1$ shown in FIG. 2, the delay control data DEL1(L1), DEL2(L1), DEL1(R1), and DEL2(R1) are supplied to the delay line 30, and the tone volume control data VOL1(L1), VOL2(L1), VOL1(R1), and VOL2(R1) are supplied to multipliers 32, 34, 36, and 38, respectively.

The delay line 30 has four output lines $S_{11}$, $S_{12}$, $S_{21}$, and $S_{22}$. These output lines are connected to delay stages corresponding to the delay stage counts indicated by the delay control data DEL1(L1), DEL2(L1), DEL1(R1), and DEL2(R1). For example, the output lines $S_{11}$ is connected to the fourth delay stage if the data DEL1(L1) indicates a delay stage count "4" and as a result, an input musical tone signal can be delayed by a desired amount.

Delayed musical tone signals derived through the output lines $S_{11}$, $S_{12}$, $S_{21}$, and $S_{22}$ are respectively supplied to the multipliers 32, 34, 36, and 38, and are multiplied with coefficients indicated by the tone volume control data VOL1(L1), VOL2(L1), VOL1(R1), and VOL2(R1). Musical tone signals as products from the multipliers 32 and 34 are mixed by a mixing circuit 40, and a musical tone signal L1 as a mixed output is supplied to a mixing circuit 44. Musical tone signals as products from the multipliers 36 and 38 are mixed by a mixing circuit 42, and a musical tone signal R1 as a mixed output is supplied to a mixing circuit 46.

The same musical tone control channels as described above are arranged in correspondence with the key groups $KG_2$ to $KG_{16}$. The mixing circuit 44 receives musical tone signals L2 to L16, similar to L1, supplied from the musical tone control channels corresponding to the key groups $KG_2$ to $KG_{16}$, and the mixing circuit 46 receives musical tone signals R2 to R16, similar to R1, supplied from the musical tone control channels corresponding to the key groups $KG_2$ to $KG_{16}$. The mixing circuit 44 outputs the left channel musical tone signal L, and the mixing circuit 46 outputs the right channel musical tone signal R.

Figure 4:
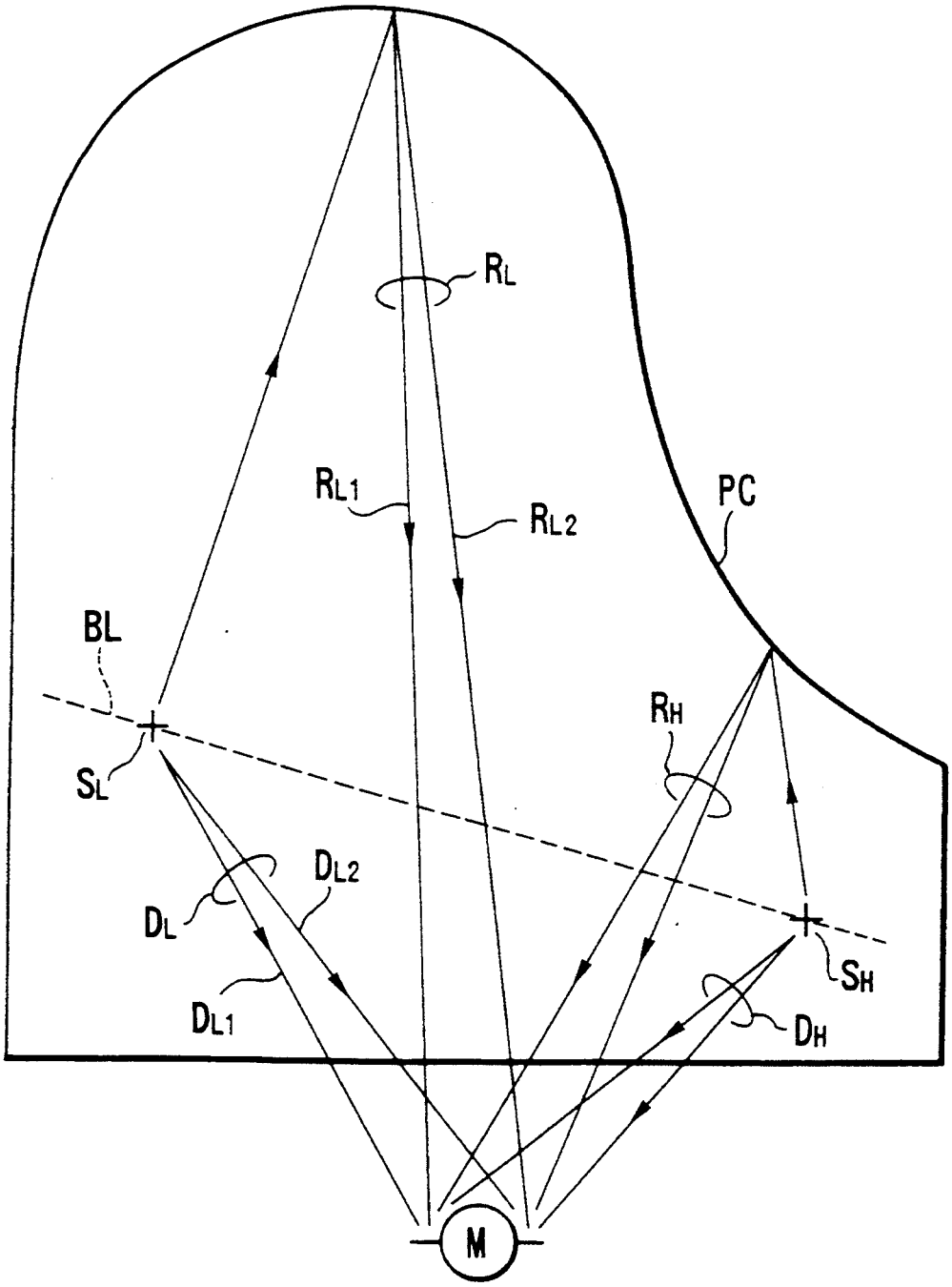
FIG. 4 is a plan view showing a piano tone generation state.

For example, in order to imitate sound generation from a sound source position $S_L$ shown in FIG. 4, values of data DEL1(L1) and VOL1(L1) associated with a direct tone $D_{L1}$ are determined, and values of data DEL2(L1) and VOL2(L1) associated with a reflected tone $R_{L1}$ are determined. In this case, the values of the data DEL1(L1) and DEL2(L1) have a difference corresponding to a delay time of $R_{L1}$ with respect to $D_{L1}$, and the values of the data VOL1(L1) and VOL2(L1) have a difference corresponding to a tone volume difference between $D_{L1}$ and $R_{L1}$. Meanwhile, values of data DEL1(R1) and VOL1(R1) associated with a direct tone $D_{L2}$ are determined, and values of data DEL2(R1) and VOL2(R1) associated with a reflected tone $R_{L2}$ are determined. In this case, the values of the data DEL1(R1) and DEL1(L1) described above have a difference corresponding to a delay time of $D_{L2}$ with respect to $D_{L1}$, and the values of the data VOL1(R1) and VOL1(L1) have a difference corresponding to a tone volume difference between $D_{L1}$ and $D_{L2}$. In addition, the values of the data DEL2(R1) and DEL2(L1) described above have a difference corresponding to a delay time of $R_{L2}$ with respect to $R_{L1}$, and the values of the data VOL2(R1) and VOL2(L1) have a difference corresponding to a tone volume difference between $R_{L1}$ and $R_{L2}$.

The data DEL1(L1), VOL1(L1), DEL2(L1), VOL2(L1), DEL1(R1), VOL1(R1), DEL2(R1), and VOL2(R1) whose values are determined in this manner are stored in the memory 18. When an arbitrary key belonging to the key group $KG_1$, e.g., $K_1$ is depressed, first and second musical tones having a pitch corresponding to the key $K_1$ and respectively approximate to $D_{L1}$ and $R_{L1}$ are generated from the loudspeaker 28(L), and third and fourth musical tones having a pitch corresponding to the key $K_1$ and respectively approximate to $D_{L2}$ and $R_{L2}$ are generated from the loudspeaker 28 (R).

Figure 5:
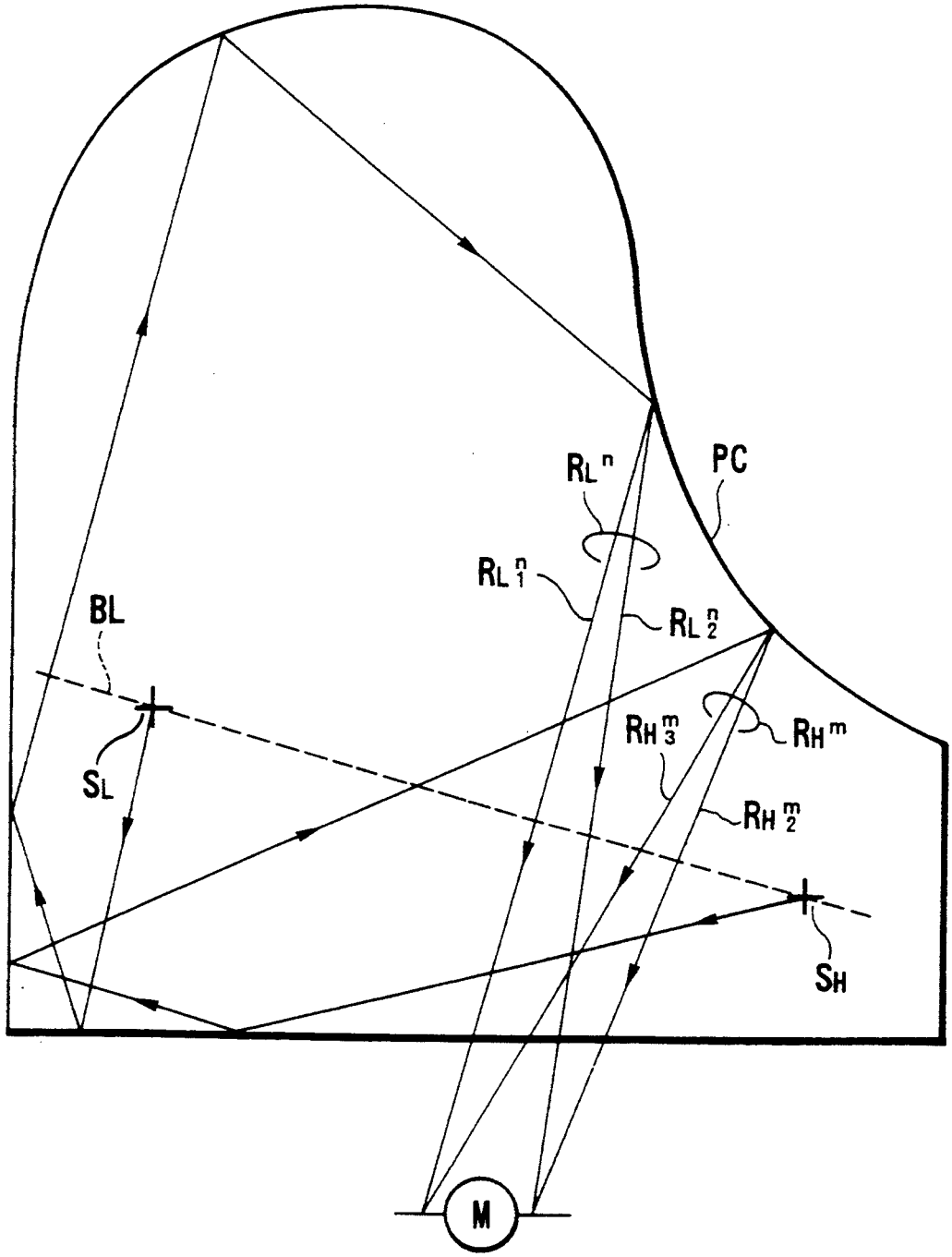
FIG. 5 is a plan view showing another piano tone generation state.

In the above embodiment, in order to express reflected tones by one wall, the delay line has four outputs. However, as shown in FIG. 5, in order to express reflected tones $R_L{}^n$ ($R_{L1}{}^n$, $R_{L2}{}^n$) and $R_H{}^m$ ($R_{H1}{}^m$, $R_{H2}{}^m$) from various directions based on tones produced from sound source positions $S_L$ and $S_H$, the number of outputs of the delay line may be increased and coefficients may be multiplied with these outputs to make control.

Modification

The present invention is not limited to the above embodiment, and various changes and modifications may be made. For example, the following modifications can be made.

(1) Musical tone control information may be stored not in units of pitch groups but in units of pitches, and the musical tone control circuit may control delay amounts and tone volumes in units of pitches on the basis of the stored information.

(2) The musical tone control information memory may store different kinds of musical tone control information in units of kinds of musical instruments (tone colors) such as a piano, organ, vibraphone, guitar, and the like, and musical tone control information corresponding to a tone color selected by a tone color selection means may be read out to control delay amounts and tone volumes. Musical tone control information may be stored in units of models of musical instruments which belong to the same type of musical instrument (e.g., in correspondence with a grand piano, an upright piano, and the like for a piano), and musical tone control information corresponding to a tone color selected by a tone color selection means may be read out to control delay amounts and tone volumes.

(3) In the above embodiment, delay control is performed and then, tone volume control is performed after delay control in units of tone generation channels. However, delay control may be performed after tone volume control. The delay amount and the tone volume may be set by a circuit technique in place of control based on information stored in the memory. However, control based on information stored in the memory like in the above embodiment is convenient since a control content can be easily changed by exchanging memories or rewriting a memory content.

(4) In the above embodiment, a musical tone signal having a designated pitch is divided into a plurality of signals to perform delay & tone volume control. A plurality of musical tone signals having a designated pitch may be parallelly generated, so that a delay amount and a tone volume of one musical tone signal with respect to the other musical tone signal may be controlled, or a plurality of musical tone signals may be generated to have a time difference and/or tone volume difference.

(5) Three or more tone generation channels may be arranged. The number of musical tone signals per tone generation channel may be three or more.

As described above, according to the present invention, tone reflection in an instrument body can be imitated, and sound image localization of an acoustic musical instrument can be faithfully imitated. Thus, a high-quality musical tone approximate to an acoustic instrument tone can be generated.

What is claimed is:

1. A musical tone generation apparatus comprising:

(a) pitch designation means for designating a pitch, said pitch designation being divided into a plurality of pitch groups;

(b) instruction means for instructing a timing shift of a second tone with respect to a first tone, the magnitude of the timing shift being controlled as a function of the designated pitch (or the pitch group to which the designated pitch belongs); and (c) signal generation means for generating first and second musical tone signals having the designated pitch and having the timing shift instructed by said instruction means in correspondence with the designated pitch (or the pitch group to which the designated pitch belongs).

2. An apparatus according to claim 1, wherein said instruction means instructs a tone volume difference between the second tone and the first tone, the magnitude of the tone volume difference being controlled as a function of the designated pitch (or the pitch group to which the designated pitch belongs), and wherein said signal generation means generates the first and second musical tone signals to have the volume difference instructed by said instruction means in correspondence with the designated pitch (or the pitch group to which the designated pitch belongs).

3. A musical tone generation apparatus comprising:

(a) pitch designation means for designating a pitch, said pitch designation means being divided into a plurality of pitch groups;

(b) tone generation means having first and second tone generation channels;

(c) instruction means for instructing a timing shift and a tone volume difference between a second tone and a first tone, the magnitude of the timing shift and of the tone volume difference being controlled as a function of the designated pitch (or the pitch group to which the designated pitch belongs); and (d) signal generation means for generating first and second musical tone signals having the designated pitch and having the timing shift and the tone volume difference instructed by said instruction means in correspondence with the designated pitch (or the pitch group to which the designated pitch belongs), wherein said tone generation means converts the musical tone signal into an acoustic wave in the corresponding tone generation channel.

4. An apparatus according to claim 3, wherein said instruction means instructs a timing shift and a tone volume difference between a third tone and the first tone and a timing shift and a tone volume difference between a fourth tone and the third tone, the magnitude of the timing shift and of the tone volume difference between the third and first tones and between the fourth and third tones being controlled as a function of the designated pitch (or the pitch group to which the designated pitch belongs), and wherein said signal generation means generates a third musical tone signal having the designated pitch and the timing shift and the tone volume difference between the first and third tones instructed by said instruction means and generates a fourth musical tone signal having the designated pitch and the timing shift and the tone volume difference between the third and fourth tones instructed by said instruction means.

5. An electronic musical tone generating apparatus comprising:

tone pitch designating means for generating at least one pitch signal representing a tone pitch;

tone generation instruction means for generating a start signal instructing tone generation;

musical tone signal generating means for generating a pair of musical tone signals representing a pair of direct sounds and a plurality of musical tone signals each representing a reflected sound in accordance with said start signal, wherein said pair of musical tone signals have a first and second tone volume, respectively, and said plurality of musical tone signals have respective tone volumes and respective tone generation times; and controlling means for controlling said respective tone volumes and said respective tone generation times in accordance with said pitch signal of said tone pitch designating means.

6. An electronic musical tone generating apparatus according to claim 5, wherein said tone pitch designating means comprises a plurality of keys, said plurality of keys are divided into a plurality of key groups, and said controlling means controls said respective tone volumes and said respective tone generation times in accordance with the key groups.

7. An electronic musical tone generating apparatus according to claim 5, wherein said controlling means produces tone volume coefficients and wherein said musical tone signal generating means comprises:

forming means for forming a musical tone signal;

a delay circuit for delaying said musical tone signal; and multiplying means for multiplying said musical tone signal formed by said forming means and said tone volume coefficients.

8. An electronic musical tone generating apparatus according to claim 7, wherein said delay circuit comprises a circuit which has no feed-back line.

9. An electronic musical tone generating apparatus according to claim 5, further comprising converting means having left and right channels, for converting said musical tone signal to musical sound.

10. An electronic musical tone generating apparatus according to claim 9, wherein said plurality of musical tone signals representing reflect sounds are grouped into a pair of signals which are assigned to said left channel and said right channel.

11. An electronic musical tone generating apparatus according to claim 9, wherein said plurality of musical tone signals representing reflect sounds are grouped into a plural pair of signals, each of a pair of said plural pair of signals is assigned either said left or said right channel.

12. An electronic musical tone generating apparatus comprising:

tone pitch designating means for designating tone pitch;

musical tone signal generating means for generating at least one musical tone signal;

delay means for producing at least one delayed musical tone signal; and stereo effect means for controlling sound image localization of said musical tone signal direct from said musical tone signal generating means and controlling sound image localization of said delayed musical tone signal in accordance with tone pitch designated by said tone pitch designating means, the sound image localization of said musical tone signal being executed independently of the sound image localization of said delayed musical tone signal.

13. An electronic musical tone generating apparatus according to claim 12, wherein said tone pitch designating means comprises a plurality of keys of a keyboard.

14. An electronic musical tone generating apparatus according to claim 13, wherein said plurality of keys are divided into a plurality of key groups, and said stereo effect means controls said sound image localization of said delayed musical tone signal in accordance with key groups.

15. An electronic musical tone generating apparatus according to claim 13, wherein said stereo effect means has left and right channels and wherein sound image localization of a tone which represents a directly generating sound is formed in the left channel when keys on the left side of said keyboard are operated, and sound image localization of a tone which represents a directly generated sound is formed in the right channel when keys on the right side of said keyboard are operated.

16. An electronic musical tone generating apparatus according to claim 12, further comprising a plurality of tone generating channels, wherein the musical tone signal generator generates a plurality of musical tone signals including a signal indicative of a direct sound and a signal indicative of a reflected sound, the signal indicative of the reflected sound being delayed by said delay means, the delayed signal being supplied to each of the plurality of tone generating channels.

17. An electronic musical tone generating apparatus according to claim 16, wherein the delay means produces a plurality of delayed signals from the signal indicative of the reflected sound, the plurality of delayed signals being supplied to corresponding channels of the plurality of channels.

18. An electronic musical tone generating apparatus according to claim 12, wherein the delay means produces the delayed signal based on the designated tone pitch.

19. An electronic musical tone generating apparatus comprising:

tone pitch designating means for designating tone pitch;

musical tone signal generating means for generating at least one musical tone signal;

reflection tone generating means for generating a reflection tone signal by delaying said musical tone signal; and stereo effect means for independently controlling localization of sound images of said musical tone signal and said reflection tone signal in accordance with tone pitch designated by said tone pitch designating means.

* * * * *